US006995117B2

(12) United States Patent
Süssenbach

(10) Patent No.: US 6,995,117 B2
(45) Date of Patent: Feb. 7, 2006

(54) TRANSLUCENT WEB-TYPE RECORDING MATERIAL AND A METHOD FOR PRODUCING THE SAME

(75) Inventor: Karsten Süssenbach, Flensburg (DE)

(73) Assignee: Mitsubishi HiTec Paper Flensburg GmbH, Flensburg (DE)

( * ) Notice: Subject to any disclaimer, the term of this patent is extended or adjusted under 35 U.S.C. 154(b) by 0 days.

(21) Appl. No.: 10/492,878

(22) PCT Filed: Oct. 16, 2001

(86) PCT No.: PCT/EP01/11934

§ 371 (c)(1),
(2), (4) Date: Apr. 16, 2004

(87) PCT Pub. No.: WO03/033272

PCT Pub. Date: Apr. 24, 2003

(65) Prior Publication Data

US 2004/0247838 A1 Dec. 9, 2004

(51) Int. Cl.
*B41M 5/40* (2006.01)

(52) U.S. Cl. ..... 503/226; 427/152; 503/200

(58) Field of Classification Search ..... 503/200, 503/206, 226; 427/152
See application file for complete search history.

(56) References Cited

U.S. PATENT DOCUMENTS

| | | | |
|---|---|---|---|
| 5,275,870 A | 1/1994 | Halope et al. | |
| 6,174,586 B1 * | 1/2001 | Peterson | 428/172 |

FOREIGN PATENT DOCUMENTS

| | | |
|---|---|---|
| DE | 39 20 378 C1 | 1/1991 |
| DE | G 93 02 105.4 | 5/1993 |
| DE | 690 01 677 T2 | 10/1993 |
| EP | 0 203 499 B1 | 12/1986 |
| EP | 0 611 664 B1 | 8/1994 |
| EP | 0 844 097 A1 | 5/1998 |
| WO | WO 94/15795 | 7/1994 |
| WO | WO 97/17493 | 5/1997 |

* cited by examiner

*Primary Examiner*—Bruce H. Hess
(74) *Attorney, Agent, or Firm*—Cohen, Pontani, Lieberman & Pavane

(57) ABSTRACT

A translucent web-type recording material includes a substrate, a recording layer for recording data on at least one side, and a pigmented intermediate layer having regions of different thickness to form markings. The pigmented layer is arranged between the substrate and the recording layer.

12 Claims, No Drawings

TRANSLUCENT WEB-TYPE RECORDING MATERIAL AND A METHOD FOR PRODUCING THE SAME

PRIORITY CLAIM

This is a U.S. national stage of application No. PCT/EP01/11934, filed on 16 Oct. 2001. Priority is claimed on that application.

BACKGROUND OF THE INVENTION

1. Field of the Invention

The invention pertains to translucent web-type recording material, which comprises a substrate; a recording layer on at least one side of the substrate, to which data can be recorded; and pigmented marking between the substrate and the recording layer. The invention also pertains to a process for the production of the recording material according to the invention.

2. Description of Prior Art

Recording materials are essential to daily life in society and to the working world. Recording materials which are to be used only by authorized persons are usually provided with a specific marking, which indicates that the material is approved for this purpose. Various solutions for providing security features which can prove the authenticity of copy materials have already been proposed in the past.

Watermarks, for example, make it possible to prove the authenticity of documents by means of a passive examination. A watermark is generally understood to be an image formed in the paper by altering the thickness of the paper in the appropriate areas. A distinction is made between true watermarks, half-true watermarks, and false watermarks. True watermarks are produced by decreasing the density of the pulp (so-called "translucent" watermarks) or by increasing the density of the pulp by the use, for example, of a dandy roll in the screen section of the paper machine (so-called "shadow watermarks"). Half-true or so-called "molette" watermarks are produced by impressing the paper in the pressing section of the paper machine while the paper is still wet. Finally, there are the false watermarks which are produced either by printing the finished paper with a colorless coating material outside the paper machine or by embossing the finished paper outside the paper machine.

Proposals for false watermarks can be found in EP 0 203 499 B 1, which provides a paper web, which, as a result of the addition of suitable substances, can be deformed by the application of heat and possibly by the simultaneous application of pressure, and in DE 39 20 378 A1, according to which a watermark is produced outside the paper machine by printing the paper with a coating material. The disadvantages of these proposals is that their realization is limited to only certain areas of application because of the need for expensive raw materials.

According to a proposal of DE 690 01 677 T2, a synthetic print carrier with false watermarks is made available. This known print carrier comprises a substrate made of plastic; at least one authentication or security symbol, which is preferably applied by intaglio printing and which changes the opacity of the print carrier; and at least one pigment coating, which can be printed onto the carrier to cover the symbol. The monochrome or polychrome symbol is said to be almost invisible in reflected light but readily visible in transmitted light. The basic disadvantage, namely, that a printed false watermark can be forged relatively easily, also applies to this known print carrier; forgery cannot be prevented by the simple pigment coatings applied over the mark.

As a first security feature in the form of a false watermark for a heat-sensitive copy material, EP 0 844 097 A1 discloses a latent image printed on the back of the recording material. This image is produced by means of a security ink containing a fluorescent reagent. To create a second security feature in the form of a waterproof image on the back of the heat-sensitive recording material, the security ink contains a water-repellent material. The fluorescent reagent used as pigment or dye and the security ink containing the water-repelling agent are contained or dispersed in an aqueous carrier, which can also contain a binder in addition to these components. The disadvantage of this proposal is that the water-repelling character of the security ink makes it more difficult to arrange preprints by the conventional printing methods as often done in practice. Preprints are form fields, produced by offset printing, for example, which are intended to be filled out later by a thermal printer, for example.

Another disadvantage of basically all false watermarks is to be found in the fact that they are applied afterwards to the finished paper by embossing or printing, for which reason it is easier to forge them than it is to forge true or half-true watermarks or even those types of watermark-like security marks which are integrated into the structure of the recording paper during the production process. The closer the creation of a safety feature to the original production point in the production and processing chain, the greater the difficulty of simulating the safety feature with the intent of forgery.

A true watermark made in the substrate of web-like recording material provided with a heat-sensitive coating is known from EP 0 611 664 B1. This watermark cannot always be detected satisfactorily in transmitted daylight, however, which makes the identification process more difficult. In addition, the devices required for production, such as customized dandy rolls, are very expensive.

SUMMARY OF THE INVENTION

Against the background of the problems discussed above, the task of the invention is to develop a web-type recording material with an authenticity-proving security feature, which material:

1. can be produced at low cost, and
2. makes reliable proof of authenticity possible even under the condition that the material has been provided with one or more coatings, where the simulation or forging of the security feature is to be virtually impossible.

Another goal of the present invention is to make available a process for the production of a web-type recording material with an authenticity-proving security feature in accordance with the features presented above.

The task described above is accomplished by a translucent web-type copy material, which comprises a substrate; a copy or recording layer on at least one side of the substrate, to which data can be recorded; and pigmented marking between the substrate and the recording layer, characterized in that the pigmented marking is formed by the application of at least one continuous intermediate layer, located between the substrate and the minimum of one recording layer, the thickness of this intermediate layer varying locally in accordance with the design of the marking.

It is preferred that the marks in the web-type copy recording material are formed by applying the pigmented intermediate layer more thickly in the areas of the marks.

Good results with respect to the task to be accomplished by the invention can be obtained when the difference between the thickness of the marks, which have been created by applying a layer of greater local thickness, and the thickness of the areas in the intermediate layer without marks is in the range of 0.1–10 μm. A thickness difference in the range between 0.1 and 5 μm is preferred.

The continuous pigmented intermediate layer of the inventive recording material contains at least one binder based on a synthetic polymer, where, for example, styrene-butadiene latex yields especially good results. The use of a synthetic binder to which at least one natural polymer is added represents an especially suitable embodiment.

With regard to the production of the intermediate layer of heat-sensitive recording materials, the present invention goes back to the pigments known in the state of the art for their ability to absorb at least 50 mL of oil per 100 g, which pigments can be used either alone or in mixtures. The invention is not, however, limited to the production of such recording materials. These pigments include: calcined or uncalcined diatomaceous earth, aluminum oxide hydroxide, magnesium carbonate, silicon dioxide, calcium carbonate, precipitated calcium carbonate, titanium dioxide, and calcined or uncalcined kaolin. The three last-mentioned pigments in particular offer especially conspicuous marks, and for this reason they are preferred.

In addition, it was determined over the course of time-consuming experiments that an especially suitable embodiment is obtained by the use, within the pigmented intermediate layer, of a binder-pigment ratio in the range of 1:10–1:20.

The continuous pigmented intermediate layer is used preferably in inventive recording materials which have on at least one side a layer designed to be printed on by the inkjet printing method.

Another embodiment provides that the recording material has a heat-sensitive recording layer at least on the side intended to receive the data to be recorded. A recording layer of this type contains not only the color-forming agents and the organic color acceptors, which react with each other under the action of heat, but also conventional additives for heat-sensitive copy layers such as resins, waxes, and stabilizers. A preferred embodiment provides a heat-sensitive recording material of this type with a protective layer, which has been applied over the heat-sensitive recording layer.

As an additional variant, a web-type recording material is proposed which has a pressure-sensitive SC (self-coloring) recording layer on the side provided to receive the data to be recorded. In addition to other additives, these SC recording layers have acceptors and microcapsules containing encapsulated color-forming agents. When subjected to pressure, the color-forming agents enter into a color-forming reaction with the acceptors.

As long as the substrate is translucent, there are practically no limitations on the type of substrate which can be used. Various types of films can be used, for example. An especially preferred embodiment is based on the use of paper for the substrate of the inventive recording materials. It is preferable for weight of the substrate per unit area to be in the range of 50–180 g/m$^2$, although the invention is not limited to this range.

The invention also comprises a process for the production of a web-type inventive recording material with a pigmented intermediate layer, in that this continuous intermediate layer is applied by means of a coater equipped with an opposing roll, and in that the opposing roll has depressions in the form of the marks to be formed. During the coating process by which the intermediate layer of pigmented coating compound is formed, the substrate is pressed by the force of a doctor blade into the engraved depressions in the opposing roll; as a result, the layer of the pigmented coating compound becomes thicker in those areas. In a preferred embodiment, blade-type coaters of the are used.

The recording materials with a continuous pigmented intermediate layer, which is applied in varying thicknesses in different areas, can also be combined suitably with other previously known security features, such as, for example, fluorescent security threads, which are incorporated into the substrate; dyes, which are applied in or on the substrate as authenticators; and possibly indicator substances, which can reveal attempts at forgery by reacting with appropriate reagents applied to the recording materials and thus develop colors.

DETAILED DESCRIPTION OF THE PREFERRED EMBODIMENT

The following example will illustrate the invention in greater detail.

EXAMPLE

On a long-wire paper machine, a paper web of bleached and ground hardwood and softwood pulp was produced with the addition of conventional additives in the conventional amounts with a weight per unit area of 160 g/m$^2$. On the front, an 8 g/m$^2$ intermediate layer containing calcined kaolin as pigment, styrene-butadiene latex as binder, starch as cobinder, and other auxiliary materials was applied by a duplex coater of the blade type, the opposing roll of which had depressions in the form of hexagons. Also with the use of the previously mentioned duplex coater, the back of the substrate was provided with a 0.3 g/m$^2$ layer of a starch preparation. To form the heat-sensitive recording material, a heat-sensitive recording layer of 5.4 g/m$^2$ was applied to the intermediate layer in an off-machine coater. The heat-sensitive recording material thus produced was then provided with a 3.5 g/m$^2$ protective layer on top of the copy recording layer.

The heat-sensitive recording papers thus produced had markings which could be seen very easily in transmitted light, these markings corresponding to the depressions in the opposing roll.

What is claimed is:

1. A translucent, web-type recording material, comprising:

a substrate;

a heat-sensitive recording layer on at least one side of said substrate arranged for receiving data to be recorded; and a pigmented continuous intermediate layer located between said substrate and said recording layer comprising areas of greater thickness and areas of lesser thickness, wherein a difference in thickness between said areas of lesser thickness and said areas of greater thickness is in the range of 0.1–10 μm and is discernible through the substrate and the heat-sensitive recording layer such that said areas of greater thickness define at least one mark on said translucent web-type recording material.

2. The web-type recording material of claim 1, wherein a difference in thickness between said areas of greater thickness and said areas of lesser thickness is in the range of 0.1–5 $\mu$m.

3. The web-type recording material of claim 1, wherein said pigmented continuous intermediate layer includes at least one binder based on a synthetic polymer.

4. The web-type recording material of claim 1, wherein said pigmented continuous intermediate layer includes at least one pigment with an oil absorption capacity of at least 50 mL/100 g as measured according to DIN 53,199 and JIS K 5101.

5. The web-type recording material of claim 1, wherein said pigmented continuous intermediate layer includes at least one pigment selected from the group consisting of kaolin, calcined kaolin, and titanium dioxide.

6. The web-type recording material of claim 1, wherein said pigmented continuous intermediate layer includes a binder and a pigment with a binder-pigment ratio in the range of 1:10–1:20.

7. The web-type recording material of claim 1, wherein at least one side of said recording material comprises a layer suitable for being printed on by an inkjet printing method.

8. The web-type recording material of claim 1, further comprising a protective layer applied over said heat-sensitive recording layer.

9. The web-type recording material of claim 1, wherein said substrate is paper.

10. The web-type recording material of claim 9, wherein said substrate has a weight per unit area of 50–180 g/m$^2$.

11. The web-type recording material of claim 1, wherein said substrate has a weight per unit area of 50–180 g/m$^2$.

12. The web-type recording material of claim 1, wherein said heat-sensitive recording layer comprises organic color acceptors and color forming agents, wherein said color-forming agents react with the acceptors in response to heat.

* * * * *